US006638367B2

(12) United States Patent
Ohmori et al.

(10) Patent No.: US 6,638,367 B2
(45) **Date of Patent: *Oct. 28, 2003**

(54) METHOD OF PRODUCING HIGHLY WEATHER-RESISTANT MAGNET POWDER, AND PRODUCT PRODUCED BY THE SAME METHOD

(75) Inventors: Kenji Ohmori, Chiba (JP); Toshiyuki Osako, Chiba (JP); Kayo Hashiguchi, Chiba (JP); Kouichi Yokosawa, Chiba (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/955,335

(22) Filed: Sep. 19, 2001

(65) Prior Publication Data

US 2002/0066499 A1 Jun. 6, 2002

(51) Int. Cl.[7] ..... H01F 1/03; C22C 22/07

(52) U.S. Cl. ..... 148/105; 148/101; 148/253; 252/62.54; 241/17; 241/23

(58) Field of Search ..... 148/101, 122, 148/253, 105; 252/62.54; 241/17, 23

(56) References Cited

U.S. PATENT DOCUMENTS 4,497,722 A * 2/1985 Tsuchida et al. ..... 252/62.54
4,668,283 A * 5/1987 Honda et al. ..... 148/105
4,933,025 A * 6/1990 Alson et al. ..... 148/104
5,067,990 A * 11/1991 Ribitch ..... 148/254
5,087,302 A * 2/1992 Lin et al. ..... 148/103

FOREIGN PATENT DOCUMENTS

| | | |
|---|---|---|
| JP | 60-240105 | 11/1985 |
| JP | 61-263208 | 11/1986 |
| JP | 5-190311 | 7/1993 |
| JP | 11-251124 | 9/1999 |
| JP | 2000-208321 | 7/2000 |

OTHER PUBLICATIONS

European Search Report dated Jan. 9, 2002.

* cited by examiner

*Primary Examiner*—John Sheehan
(74) *Attorney, Agent, or Firm*—Armstrong Westerman & Hattori, LLP

(57) ABSTRACT

The objects of the present invention are to provide a method of producing highly weather-resistant iron-based magnet powder containing a rare-earth element, particularly characterized by high coercive force in a practically important humid atmosphere, highly weather-resistant magnet powder produced by the same method, resin composition containing the same powder for bonded magnets, and bonded magnet containing the same powder. The present invention provides a method of producing a magnet powder by crushing an iron-based magnet powder containing a rare-earth element in an organic solvent, wherein phosphoric acid is added to the solvent in which the powder is crushed.

6 Claims, No Drawings

METHOD OF PRODUCING HIGHLY WEATHER-RESISTANT MAGNET POWDER, AND PRODUCT PRODUCED BY THE SAME METHOD

FIELD OF THE INVENTION

This invention relates to a method of producing highly weather-resistant magnet powder and the product produced by the same method, more particularly a method of producing highly weather-resistant iron-based magnet powder containing a rare-earth element, highly weather-resistant magnet powder produced by the same method, resin composition containing the same powder for bonded magnets, and bonded magnet.

BACKGROUND OF THE INVENTION

The ferrite, Alnico and rare-earth magnets have been used for various purposes, e.g., motors. However, these magnets are mainly produced by the sintering method, and have various disadvantages. For example, they are generally fragile and difficult to form into thin or complex-shape products. In addition, they are low in dimensional precision, because of significant shrinkage of 15 to 20% during the sintering step, and need post-treatment, e.g., grinding, to improve their precision.

On the other hand, bonded magnets have been recently developed, in order to solve these disadvantages and, at the same time, to develop new applications. Bonded magnets are generally produced by filling them with a magnetic powder using a thermoplastic resin, e.g., polyamide or polyphenylene sulfide resin, as the binder.

Of these bonded magnets, those comprising iron-based magnetic powder, especially the ones containing a rare-earth element, tend to be rusted and lose their magnetic characteristics in a high temperature, humid atmosphere. To overcome these problems, the surface of the compact is coated with a film of, e.g., thermosetting resin or phosphate-containing coating material (as disclosed by Japanese Patent Laid-Open No.208321/2000), to prevent rusting. Nevertheless, however, they are still insufficient in rust-preventive effects and magnetic properties, e.g., coercive force.

It is necessary, when an iron-based magnet powder containing a rare-earth element is kneaded together with a resin for a bonded magnet, to crush the magnet alloy powder to several microns, in order to secure sufficient magnetic characteristics. The magnet alloy powder is normally crushed in an inert gas or solvent. However, finely crushing a magnet powder causes a problem. The finely crushed powder is so active that, when coming into contact with air before being coated, it will be rapidly rusted by oxidation to lose its magnetic characteristics.

Several attempts have been made to solve the above type of problems. For example, a magnet alloy powder is slowly oxidized, after it is crushed to several microns, with a very small quantity of oxygen introduced into the inert atmosphere. Another measure is coating the crushed magnet powder with a phosphate, as disclosed by Japanese Patent Laid-Open No.251124/1999.

However, the crushed magnetic particles agglomerate with each other by the magnetic force. Such a powder, although improved in resistance to weather in a dry atmosphere, is not satisfactorily improved in the practically important resistance in a humid atmosphere, even when the agglomerated particles are protected with the coating film, conceivably because of insufficient protection of the individual particles. Therefore, coating the powder still fails to solve the problem.

Under these circumstances, small-size motors, acoustic devices, OA devices or the like have been recently required to be still smaller, which requires the bonded magnets therefor to have still improved magnetic characteristics. However, the magnetic characteristics of the bonded magnet of the conventional iron-based magnet powder containing a rare-earth element are insufficient for the above purposes. Therefore, it is strongly desired to improve magnetic characteristics of bonded magnets in the early stage by improving resistance of the iron-based magnet powder containing a rare-earth element to weather.

It is an object of the present invention to provide a method of producing highly weather-resistant iron-based magnet powder containing a rare-earth element, particularly characterized by high coercive force in a practically important humid atmosphere, to solve the problems involved in the conventional techniques. It is another object of the present invention to provide a highly weather-resistant magnet powder produced by the same method. It is still another object of the present invention to provide a resin composition containing the same powder for bonded magnets. It is still another object of the present invention to provide a bonded magnet containing the same powder.

DISCLOSURE OF THE INVENTION

The inventors of the present invention have found, after having extensively studied to achieve the above objects, that a method of producing a magnet powder by crushing an iron-based magnet powder containing a rare-earth element in an organic solvent gives the desired magnet powder excellent in resistance to weather and controlled in decline of coercive force in a humid atmosphere, when phosphoric acid is added to the solvent in which the powder is crushed, reaching the present invention.

The first invention provides the method of producing a highly weather-resistant magnet powder by crushing an iron-based magnet powder containing a rare-earth element in an organic solvent, characterized by adding phosphoric acid to the solvent in which the powder is crushed.

The second invention provides the method of the first invention for producing a highly weather-resistant magnet powder, wherein phosphoric acid is added at 0.1 mols or more but less than 2 mols per kg of the magnet alloy powder.

The third invention provides the method of the first invention for producing a highly weather-resistant magnet powder, wherein the crushed magnet alloy powder is thermally treated at 100° C. or higher but lower than 400° C. in an inert or vacuum atmosphere.

The fourth invention provides a highly weather-resistant magnet powder produced by one of the first to third inventions.

The fifth invention provides a resin composition for bonded magnets, containing, as the main ingredient, the highly weather-resistant magnet powder of the fourth invention.

The sixth invention provides a bonded magnet produced by forming the resin composition of the fifth invention for bonded magnets.

PREFERRED EMBODIMENTS OF THE INVENTION

The present invention is described more concretely.

1. Magnet Alloy Powder

The magnet alloy powder for the present invention is not limited, so long as it is an iron-based magnet alloy powder at least containing a rare-earth element. Some of the examples include rare-earth/iron/boron-based and rare-earth/iron/nitrogen-based magnetic powders normally used for bonded magnets. Of these, the more preferable ones include Nd—Fe—B-based alloy powder produced by a rapid quenching method, Sm—Fe—N-based alloy powder, Sm—Fe—N-based alloy powder coated with chemically reacted zinc, Nd—(Dy, Tb)—Fe—B-based alloy powder and Sm—Fe—Co—N-based alloy powder.

2. Method of Producing Highly Weather-Resistant Magnet Powder

The method of the present invention for producing a magnet powder includes crushing an iron-based magnet powder containing a rare-earth element in an organic solvent, wherein a given quantity of phosphoric acid is added to the solvent in which the powder is crushed.

Phosphoric acid useful for the present invention is not limited. Commercially available, normal phosphoric acid, e.g., 85% aqueous solution of phosphoric acid, may be used.

The method of adding phosphoric acid is not limited. For example, it may be added to the organic solvent in which the powder is crushed by an agitation mill. It may be added all at once before the crushing is started or little by little during the crushing process, in such a way to have a given content in the final stage. It is essential for phosphoric acid to be always present in the solvent to treat the new surfaces on the fractured particles immediately after they are produced by crushing. The organic solvent useful for the present invention is not limited. Some of the solvents normally used include alcohols, e.g., ethanol and isopropyl alcohol, ketones, lower hydrocarbons, aromatics and a mixture thereof.

The adequate content of phosphoric acid depends on, e.g., particle size and surface area of the crushed magnet powder, and is not set sweepingly. Normally, however, it is added at 0.1 mols or more but less than 2 mols per kg of the magnet alloy powder, preferably 0.15 to 1.5 mols/kg, more preferably 0.2 to 0.4 mols/kg. At less than 0.1 mols/kg, treatment of the magnet powder surfaces is insufficient to have improved resistance to weather. Moreover, the powder is oxidized and heated, when dried in air, to have rapidly deteriorated magnetic characteristics. At 2 mols/kg or more, on the other hand, phosphoric acid reacts rapidly with the magnet powder, to dissolve it in the solution.

It is preferable for the present invention to thermally treat the phosphoric acid-treated magnet powder at 100° C. or higher but lower than 400° C. in an inert or vacuum atmosphere. When treated at lower than 100° C., the magnet powder is dried insufficiently and formation of the stable surface coating film will be retarded. Treatment at 400° C. or higher, on the other hand, causes a problem of deteriorated coercive force of the magnet powder, conceivably because it is damaged under the thermal condition.

The conventional method needs slow oxidation of the magnet powder by carefully introducing a small quantity of oxygen in the inert atmosphere, to prevent its oxidation. This invariably extends the drying time, possibly pushing up the production cost. For the temporal changes in magnetic characteristics of the treated magnet powder, it keeps a relatively high coercive force at 80° C. in a dry atmosphere, but loses around 60% of the initial coercive force, when left at 80° C. and RH 90% for 24 hours.

The drying time can be reduced in the method of the present invention astonishingly without needing any special condition except that the magnet alloy powder is dried in an inert or vacuum atmosphere by merely adding an adequate quantity of phosphoric acid during the powder crushing process, conceivably because phosphoric acid triggers a mechanochemical mechanism to form a coating film over the magnet powder surfaces. The treated magnet powder remains essentially unchanged in coercive force even when exposed to an atmosphere of 80° C. and RH 90% for 24 hours, showing greatly improved resistance to weather. The excellent function/effect is just unexpected, although the mechanism involved therein has not been understood yet.

3. Resin Composition for Bonded Magnets, and Bonded Magnet

The methods of producing the resin composition for bonded magnets and bonded magnet using the highly weather-resistant magnet powder of the present invention are not limited. For example, the following known thermoplastic resins and additives can be used for producing them.

Thermoplastic Resins

The thermoplastic resin serves as the binder for the magnet powder. It is not limited, and a known one can be used.

The concrete examples of the thermoplastic resins include polyamide resins, e.g., 6-nylon, 6,6-nylon, 11-nylon, 12-nylon, 6,12-nylon, aromatic nylon and modified nylon which is one of the above compounds partly modified, straight-chain polyphenylene sulfide, crosslinked polyphenylene sulfide, semi-crosslinked polyphenylene sulfide, low-density polyethylene, linear, low-density polyethylene, high-density polyethylene, ultrahigh-molecular-weight polyethylene, polypropylene, ethylene/vinyl acetate copolymer, ethylene/ethyl acrylate copolymer, ionomer, polymethyl pentene, polystyrene, acrylonitrile/butadiene/styrene copolymer, acrylonitrile/styrene copolymer, polyvinyl chloride, polyvinylidene chloride, polyvinyl acetate, polyvinyl alcohol, polyvinyl butyral, polyvinyl formal, methacryl, polyvinylidene fluoride, polyethylene chloride trifluoride, ethylene tetrafluoride/propylene hexafluoride copolymer, ethylene/ethylene tetrafluoride copolymer, ethylene tetrafluoride/perfluoroalkylvinyl ether copolymer, polytetrafluoroethylene, polycarbonate, polyacetal, polyethylene terephthalate, polybutylene terephthalate, polyphenylene oxide, polyallyl ether allyl sulfone, polyether sulfone, polyetheretherketone, polyallylate, aromatic polyester, cellulose acetate resins, an elastomer of one of the above resins. Each of the above resins may be a homopolymer, or random, block or graft copolymer with another type of monomer. Moreover, it may be modified with another compound at the terminal.

Melt viscosity and molecular weight of the above thermoplastic resin is preferably on the lower side in an acceptable range to secure required mechanical strength of the bonded magnet for which it is used. The thermoplastic resin may be in any form, e.g., powder, bead or pellet, of which powder is more preferable for producing a uniform mixture of the magnet powder.

The thermoplastic resin is incorporated normally at 5 to 100 parts by weight per 100 parts by weight of the magnet powder, preferably 5 to 50 parts by weight. At less than 5 parts by weight, the composition may have an excessive kneading resistance (torque) or lose fluidity, making it difficult to form the composition into a magnet. At more than 100 parts by weight, on the other hand, the composition may not have desired magnetic characteristics.

(Other Additives)

The composition for bonded magnets which use the highly weather-resistant magnet powder of the present invention may be incorporated with one or more types of additives, e.g., lubricant for plastic forming and stabilizer, within limits not harmful to the object of the present invention.

The lubricants useful for the present invention include wax, e.g., paraffin, liquid, polyethylene, polypropylene, ester, carnauba and micro wax; fatty acids, e.g., stearic, 1,2-oxystearic, lauric, palmitic and oleic acid; fatty acid salts (metal soaps), e.g., calcium stearate, barium stearate, magnesium stearate, lithium stearate, zinc stearate, aluminum stearate, calcium laurate, zinc linoleate, calcium ricinoleate and zinc 2-ethylhexonate; fatty acid amides, e.g., stearic acid amide, oleic acid amide, erucic acid amide, behenic acid amide, palmitic acid amide, lauric acid amide, hydroxystearic acid amide, methylenebisstearic acid amide, ethylenebisstearic acid amide, ethylenebislauric acid amide, distearyladipic acid amide, ethylenebisoleic acid amide, dioleiladipic acid amide and N-stearylstearic acid amide; fatty acid esters, e.g., butyl stearate; alcohols, e.g., ethylene glycol and stearyl alcohol; polyethers, e.g., polyethylene glycol, polypropylene glycol, polytetramethylene glycol and modified compounds thereof, polysiloxanes, e.g., dimethyl polysiloxane and silicon grease; fluorine compounds, e.g., fluorine-based oil, fluorine-based grease and fluorine-containing resin powder; and powders of inorganic compounds, e.g., silicon nitride, silicon carbide, magnesium oxide, alumina, silicon dioxide and molybdenum disulfide. These lubricants may be used either individually or in combination. The lubricant is incorporated normally at 0.01 to 20 parts by weight per 100 parts by weight of the magnet powder, preferably 0.1 to 10 parts by weight.

The stabilizers useful for the present invention include hindered amine-based ones, e.g., bis(2,2,6,6-tetramethyl-4-piperidyl)sebacate, bis(1,2,2,6,6-pentamethyl-4-piperidyl) sebacate, 1-[2-{3-(3,5-di-tert.butyl-4-hydroxyphenyl) propionyloxy}ethyl]-4-{3-(3,5-di-tert.butyl-4-hydroxyphenyl)propionyloxy}-2,2,6,6-tetramethyl piperidine, 8-benzyl-7,7,9,9-tetramethyl-3-octyl-1,2,3-triazaspiro [4,5]undecane-2,4-dione, 4-benzoyloxy-2,2,6,6-tetramethyl piperidine, a polycondensate of dimethyl succinate-1-(2-hydroxyethyl)-4-hydroxy-2,2,6,6-tetramethyl piperidine, poly[[6-(1,1,3,3-tetramethylbutyl) imino-1,3,5-triazine-2,4-diyl][2,2,6,6-tetra methyl-4-piperidyl]imino]hexamethylene [[2,2,6,6-tetramethyl-4-piperidyl]i mino]], and 2-(3,5-di-tert.butyl-4-hydroxybenzyl)2-n-butyl malonate bis(1,2,2,6,6-pentamethyl-4-piperidyl); and antioxidants, e.g., phenol-, phosphite- and thioether-based ones. These stabilizers may be also used either individually or in combination. The stabilizer is incorporated normally at 0.01 to 5 parts by weight per 100 parts by weight of the magnet powder, preferably 0.05 to 3 parts by weight.

The method of mixing these components is not limited, and the mixing may be effected by a mixer, e.g., ribbon blender, tumbler, Nauta mixer, Henschel mixer or supermixer; or kneading machine, e.g., Banbury mixer, kneader, roll, kneader-ruder, or monoaxial or biaxial extruder. The composition for bonded magnets thus produced may be in the form of powder, bead, pellet or a combination thereof, of which pellet form is preferable for ease of handling.

Next, the composition of bonded magnets is heated and melted at a melting point of the thermoplastic resin component, and then formed into a magnet of desired shape. It may be formed by a known plastic molding method, e.g., injection molding, extrusion, injection compression molding, injection pressing, or transfer molding, of which injection molding, extrusion, injection compression molding and injection pressing are preferable.

PREFERRED EMBODIMENTS

EXAMPLES

The present invention is described more concretely by EXAMPLES and COMPARATIVE EXAMPLES, which by no means limit the present invention. The details of the components and evaluation method used in EXAMPLES and COMPARATIVE EXAMPLES are described.

(1) Components

Magnet Alloy Powder

Sm—Fe—N-based magnetic alloy powder (Sumitomo Metal Mining), average particle size: 50 $\mu$m Phosphoric acid 85% Aqueous solution (phosphoric acid, Kanto Kagaku)

(2) Evaluation Method

Evaluation of Coercive Force

The magnet powder sample prepared was left in an atmosphere of 80° C. and RH 95% for 1 or 24 hours, and measured for its coercive force at normal temperature by a vibrating sample magnetometer.

Examples 1 to 5, and Comparative Examples 1, 2, 3, 5 and 6

The magnet alloy powder was crushed in ethanol containing the phosphoric acid by a solvent-agitating mill for 2 hours, and dried at room temperature or a given temperature in a vacuum or argon atmosphere for 1 hour, to prepare the magnet powder. Addition rate of the phosphoric acid, and drying temperature and atmosphere for each run are given in Table 1. Each magnet powder thus prepared was evaluated by the above-described method. The results are given in Table 1.

Comparative Example 4

The magnet alloy powder was crushed in ethanol, and dried at room temperature in a vacuum atmosphere while oxygen was introduced little by little for slow oxidation, to prepare the magnet powder. The magnet powder was evaluated by the above-described method. The results are given in Table 1.

Comparative Example 7

The magnet alloy powder was crushed in ethanol, and the phosphoric acid was added at a rate given in Table 1, and the resultant solution was agitated. It was dried at room temperature in a vacuum atmosphere, to prepare the magnet powder. The magnet powder thus prepared was evaluated by the above-described method. The results are given in Table 1.

TABLE 1

| | Coercive force $H_{CJ}$ at 80° C. and RH 90% | | | | | |
|---|---|---|---|---|---|---|
| | Addition rate of the | | | | Coercive force $H_{CJ}$ (kOe) | |
| | phosphoric acid mol/kg | pH | Drying temperature ° C. | Drying atmosphere | Test time: 1 hour | Test time: 24 hours |
| COMPARATIVE EXAMPLE 1 | 0.3 | 3.5 | Room temperature | Vacuum | 10.5 | 9.2 |
| EXAMPLE 1 | 0.3 | 3.5 | 150 | Argon gas | 10.1 | 10.7 |
| EXAMPLE 2 | 0.3 | 3.5 | 150 | Vacuum | 11.4 | 11.3 |
| EXAMPLE 3 | 0.3 | 3.5 | 200 | Vacuum | 10.4 | 10.9 |

TABLE 1-continued

| | Coercive force $H_{CJ}$ at 80° C. and RH 90% | | | | | |
|---|---|---|---|---|---|---|
| | Addition rate of the phosphoric acid mol/kg | pH | Drying temperature ° C. | Drying atmosphere | Coercive force $H_{CJ}$ (kOe) Test time: 1 hour | Test time: 24 hours |
| EXAMPLE 4 | 0.4 | 2.8 | 150 | Argon gas | 10.0 | 10.1 |
| EXAMPLE 5 | 0.2 | 4.2 | 150 | Argon gas | 10.2 | 10.2 |
| COMPARATIVE EXAMPLE 2 | 0 | 7 | Room temperature | Vacuum | Oxidized to generate heat, Magnetism lost | |
| COMPARATIVE EXAMPLE 3 | 0.1 | 5.8 | Room temperature | Vacuum | Oxidized to generate heat, Magnetism lost | |
| COMPARATIVE EXAMPLE 4 | 0 | 7 | Room temperature | Vacuum (slow oxidation) | 10.1 | 2.6 |
| COMPARATIVE EXAMPLE 5 | 2 | 2.5 | The magnet powder dissolved, and crushing process suspended | | | |
| COMPARATIVE EXAMPLE 6 | 0.3 | 3.5 | 400 | Vacuum | 4.0 | 4.0 |
| COMPARATIVE EXAMPLE 7 | 0.3 | 2.8 | Room temperature | Vacuum | 10.1 | 6.3 |

As shown in Table 1, the magnet powder prepared by the method of the present invention has greatly restrained decrease in coercive force, conceivably because its surfaces are completely protected by the coating film formed by the reaction with phosphoric acid. Neither oxidation nor generation of heat was observed, when the powder was exposed to air. The drying treatment stabilized the surface coating film, further restraining the coercive force from declining.

INDUSTRIAL APPLICABILITY

As described above, the magnet powder prepared by the method of the present invention shows much higher resistance to weather than the conventional one, conceivably because it is protected by the coating film covering its surfaces, formed by phosphoric acid added while it is being crushed. The agglomerates of the dried magnet particles can be broken without generating heat, which allows the powder to be handled more easily when kneaded with the resin for production a bonded magnet, and prevents heat-caused deterioration of the magnetic characteristics. The magnet powder produced by the method of the present invention is of great industrial importance, because it can give highly weather-resistant bonded magnets.

We claim:

1. A method of producing a highly weather-resistant magnet powder comprising the steps of:

crushing an iron-based magnet alloy powder containing a rare-earth element in an organic solvent which contains phosphoric acid at more than 0.1 mol but less than 2 mols per kg of the magnet alloy powder to the solvent in which said powder is crushed, and said magnet alloy powder is thermally treated at 100° C. or higher but lower than 400° C. in an inert or vacuum atmosphere.

2. A highly weather-resistant magnet powder produced by claim 1.

3. A resin composition for bonded magnets, containing, as the main ingredient, the highly weather-resistant magnet powder of claim 2.

4. A bonded magnet produced by forming the resin composition of claim 3.

5. A highly weather-resistant magnet powder produced by claim 1 wherein said iron-based magnet alloy powder is an Sm—Fe—N magnet alloy powder.

6. A method of producing a highly weather-resistant magnet powder according to claim 1, wherein said phosphoric acid content is more than 0.15 mol but less than 2 mols per kg of the magnet powder to the solvent in which said powder is crushed.

* * * * *